United States Patent [19]

Lubinsky et al.

[11] Patent Number: 4,614,420

[45] Date of Patent: Sep. 30, 1986

[54] MAGNETICALLY AGITATED DEVELOPMENT SYSTEM

[75] Inventors: Anthony R. Lubinsky, Webster; James E. Williams, Rochester, both of N.Y.

[73] Assignee: Xerox Corporation, Stamford, Conn.

[21] Appl. No.: 499,578

[22] Filed: May 31, 1983

[51] Int. Cl.[4] ..... G03G 15/09

[52] U.S. Cl. ..... 355/3 DD; 118/657; 355/16

[58] Field of Search ..... 118/33, 656–658; 355/3 DD, 14 D, 15, 16; 430/120–122, 110

[56] References Cited

U.S. PATENT DOCUMENTS

| | | | |
|---|---|---|---|
| 3,703,395 | 11/1972 | Drexler et al. | 430/121 |
| 3,893,935 | 7/1975 | Jadwin et al. | 430/110 |
| 4,013,041 | 3/1977 | Armstrong et al. | 118/656 |
| 4,114,261 | 9/1978 | Weiler | 355/3 DD |
| 4,126,100 | 11/1978 | Nishihama et al. | 118/658 |
| 4,173,405 | 11/1979 | Swapceinski et al. | 355/3 DD |
| 4,194,830 | 3/1980 | Ohnuma et al. | 355/3 DD |
| 4,328,762 | 5/1982 | Wada | 355/3 DD X |
| 4,330,193 | 5/1982 | Stange | 355/3 DD |
| 4,354,763 | 10/1982 | Koiso et al. | 355/3 DD X |
| 4,365,586 | 12/1982 | Hosono et al. | 355/3 DD X |
| 4,391,503 | 7/1983 | Pugh | 118/658 X |
| 4,397,264 | 8/1983 | Hatch | 118/656 |
| 4,398,496 | 8/1983 | Kopko | 118/658 |
| 4,417,802 | 11/1983 | Forbes, II | 355/3 DD |
| 4,442,790 | 4/1984 | Swapceinski et al. | 118/658 X |
| 4,459,345 | 7/1984 | Probst | 430/122 |
| 4,461,238 | 7/1984 | Baier et al. | 355/3 DD X |
| 4,461,562 | 7/1984 | Goldfinch | 355/3 DD |
| 4,464,041 | 8/1984 | Haneda et al. | 355/3 DD |
| 4,466,730 | 8/1984 | Jugle | 355/3 DD |
| 4,466,731 | 8/1984 | Champion et al. | 355/3 DD X |
| 4,466,732 | 8/1984 | Folkins | 355/3 DD X |

OTHER PUBLICATIONS

Co-pending patent application Ser. No. 111,450; (now abandoned); filed Jul. 11, 1980; Kopko et al.

Research Disclosure Journal; Jul. 1979; p. 352, No. 18318; disclosed by Swapceinski.

*Primary Examiner*—R. L. Moses

*Attorney, Agent, or Firm*—H. Fleischer; J. E. Beck; R. Zibelli

[57] ABSTRACT

An apparatus in which a developer roller transports developer material into contact with a flexible member in a development zone so as to develop a latent image recorded thereon. The developer material being transported through the development zone on the developer roller is magnetically agitated to improve development of the latent image.

13 Claims, 3 Drawing Figures

MAGNETICALLY AGITATED DEVELOPMENT SYSTEM

This invention relates generally to an electrophotographic printing machine, and more particularly concerns an apparatus for developing a latent image recorded on a photoconductive surface.

Generally, an electrophotographic printing machine includes a photoconductive member which is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the orginal document. After the electrostatic latent image is recorded on the photoconductive member, the latent image is developed by bringing a developer material into contact therewith. This forms a powder image on the photoconductive member which is subsequently transferred to a copy sheet. Finally, the copy sheet is heated to permanently affix the powder image thereto in image configuration.

Frequently, the developer material is made from a mixture of carrier granules and toner particles. The toner particles adhere triboelectrically to the carrier granules. This two-component mixture is brought into contact with the latent image. Toner particles are attracted from the carrier granules to the latent image forming a powder image on the photoconductive surface. Hereinbefore, as the charged toner particles were deposited on the latent image, the brush of developer material accumulated a countercharge which, in turn, collapsed the original electrical field responsible for development. Various approaches have been devised to overcome this problem. For example, in an insulating magnetic brush development system, the speed and number of developer rollers transporting the developer material is typically increased until, by supplying fresh developer material at a sufficiently rapid rate, the field collapse problem is overcome and sufficient solid area development attained. In a conductive magnetic brush development system, the brush of developer material has a time constant for electrical charge relaxation which is short compared to the amount of time that the developer material spends in the development zone. In this way, the countercharge is transported away, and the brush of developer material developing the latent image is effectively maintained at the potential of the electrical bias applied to the developer roller. Still another approach causes a high mechanical sheer between the brush of developing material and the photoconductive surface. This results in agitation of the developer material and physically transports the countercharge away from the latent image. However, each of the foregoing approaches has a disadvantage. What is desired is a technique for removing the field collapse limitation while, simultaneously maintaining the effective electrical spacing between the brush of developer material and the photoconductive surface fairly large with developer roller speed remaining low and the frictional force between the brush of developer material and the photoconductive surface being at a minimal level.

Hereinbefore, a mechanical shear between the brush of developer material and the photoconductive surface has been achieved to agitate the developer material passing therethrough. This was achieved by wrapping the photoconductive belt about the developer roller through an extended arc. However, under these circumstances wear of the photoconductive belt is increased. Furthermore, this approach could not be used without wrapping the belt, i.e. for a platen supporting belt. The following disclosures appear to be relevant:

U.S. Pat. No. 4,013,041
Patentee: Armstrong et al.
Issued: Mar. 22, 1977
Research Disclosure Journal
July, 1979
Page 352, No. 18318
Disclosed By: Swapceinski
U.S. Pat. No. 4,499,851
Issued: Feb. 19, 1985
Patentee: Kopko et al.
U.S. Pat. No. 4,397,264
Issue: Aug. 9, 1933
Patentee: Hatch The pertinent portions of the foregoing disclosure may be briefly summarized as follows:

Armstrong et al. discloses an electrophotographic printing machine having a magnetic brush developer roller contacting one side of a flexible photoconductive belt. As shown in FIG. 3, guide rollers maintain a portion of the belt in a slackened condition so that the belt is capable of moving freely toward and away from the developer roller in response to the varying contours thereof.

Swapceinski describes an electrophotographic printing machine including a gimballed back-up roller engaging the backside of a photoconductive belt. The guide rollers, opposed from the developer roller, compensate for relative changes in the thickness of the developer material on the developer roller, as well as maintaining constant pressure in the nip between the developer roller and photoconductive belt.

Both Kopko et al. and Hatch describe an electrophotographic printing machine in which developer material on a developer roller deflects a tensioned photoconductive belt so as to wrap around the developer roller.

In accordance with the features of the present invention, there is provided an apparatus for developing a latent image recorded on a member. Means, positioned closely adjacent to the member defining a development zone therebetween, transport developer material into contact with the member in the development zone so as to develop the latent image recorded thereon. Means agitate magnetically the developer material transported through the development zone on the transporting means to improve development of the latent image.

Pursuant to another aspect of the features of the present invention, there is provided an electrophotographic printing machine of the type having an electrostatic latent image recorded on a photoconductive member. Means, positioned closely adjacent to the photoconductive member defining a development zone therebetween, transport developer material into contact with the photoconductive member in the development zone so as to develop the electrostatic latent image recorded thereon. Means are provided for agitating magnetically the developer material being transported through the development zone on the transporting means to improve development of the electrostatic latent image recorded on the photoconductive member.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
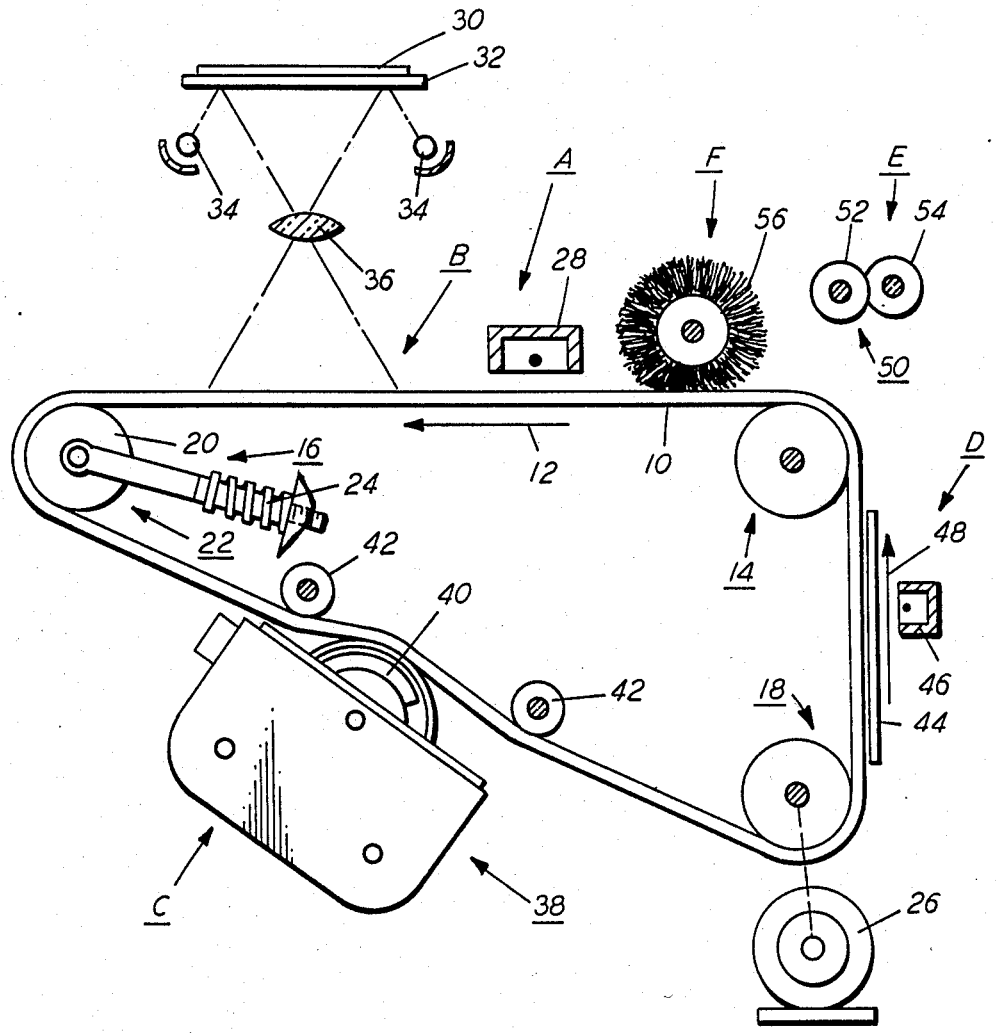
FIG. 1 is a schematic elevational view depicting an electrophotographic printing machine incorporating the features of the present invention therein.

For a general understanding of the illustrative electrophotographic printing machine incorporating the features of the present invention therein, reference is made to the drawings. In the drawings, like reference numerals have been used throughout to designate identical elements. FIG. 1 schematically depicts the various components of an electrophotographic printing machine employing the development system of the present invention therein. Although this development system is particularly well adapted for use in the illustrative electrophotographic printing machine, it will become evident from the following discussion that it is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface deposited on a conductive substrate. By way of example, the photoconductive surface includes a charge generator layer having photoconductive particles randomly dispersed in an electrically insulating organic resin. The conductive substrate comprises a charge transport layer having a transparent, electrically inactive polycarbonate resin with one or more diamines dissolved therein. Belt 10 moves in the direction of arrow 12 to advance successive portions of the photoconductive surface sequentially through the various processing stations disposed about the path of movement thereof. The path of movement of belt 10 is defined by stripping roller 14, tensioning system 16, and drive roller 18. As shown in FIG. 1, tensioning system 16 includes a roller 20 over which belt 10 moves. Roller 20 is mounted rotatably in yoke 22. Spring 24, which is initially compressed, resiliently urges yoke 22 in a direction such that roller 20 presses against belt 10. The level of tension is relatively low permitting belt 10 to be easily deflected. The detailed structure of the tensioning system will be described hereinafter with reference to FIG. 2. With continued reference to FIG. 1, drive roller 18 is mounted rotatably and in engagement with belt 10. Motor 26 rotates roller 18 to advance belt 10 in the direction of arrow 12. Roller 18 is coupled to motor 26 by suitable means such as a belt drive. Stripping roller 14 is freely rotatable so as to permit belt 10 to move in the direction of arrow 12 with a minimum of friction.

Initially, a portion of belt 10 passes through charging station A. At charging station A, a corona generating device, indicated generally by the reference numeral 28, charges the photoconductive surface of belt 10 to a relatively high, substantially uniform potential.

Next, the charged portion of the photoconductive surface is advanced through exposure station B. At exposure station B, an original document 30 is positioned facedown upon transparent platen 32. Lamps 34 flash light rays onto original document 30. The light rays reflected from original document 30 are transmitted through lens 36 forming a light image thereof. Lens 36 focuses the light image onto the charged portion of the photoconductive surface to selectively dissipate the charge thereon. This records an electrostatic latent image on the photoconductive surface which corresponds to the informational areas contained within original document 30. One skilled in the art will appreciate that a modulated beam of energy, e.g. a laser beam, may be employed to irradiate selected portions of the charged photoconductive surface to recored the electrostatic latent image thereon. The beam of energy is modulated by electronic signals corresponding to information desired to be reproduced. Systems of this type may be employed in association with computer systems to print the desired information therefrom. After the electrostatic latent image is recorded on the photoconductive surface, belt 10 advances the electrostatic latent image to development station C.

At development station C, a magnetic brush development system, indicated generally by the reference numeral 38, advances a developer material into contact with the electrostatic latent image. Preferably, magnetic brush development system 38 includes a developer roller 40. Developer roller 40 transports a brush of developer material comprising carrier granules and toner particles into contact with belt 10. As shown in FIG. 1, developer roller 40 is positioned such that the brush of developer material deflects belt 10 between idler rollers 42 in an arc with belt 10 wrapping around developer roller 40 to define a wrapped development zone. the electrostatic latent image attracts the toner particles from the carrier granules forming a toner powder image on the photoconductive surface of belt 10. The detailed structure of the magnetic brush development system 38 will be described hereinafter with reference to FIG. 3.

One skilled in the art will appreciate that the photoconductive belt may also be supported on a platen and need not wrap around the developer roller.

After development, belt 10 advances the toner powder image to transfer station D. At transfer station D, a sheet of support material 44 is moved into contact with the toner powder image. Sheet 44 is advanced to transfer station D by a sheet feeding apparatus (not shown). Preferably, the sheet feeding apparatus includes a feed roll contacting the uppermost sheet of a stack of sheets. The feed roll rotates so as to advance the uppermost sheet from the stack into a chute. The chute directs the advancing sheet of support material into contact with the photoconductive surface of belt 10 in a timed sequence so that the toner powder image developed thereon contacts the advancing sheet of support material at transfer station D.

Transfer station D includes a corona generating device 46 which sprays ions onto the back side of sheet 44. This attracts the toner powder image from the photoconductive surface to sheet 44. After transfer, sheet 44 moves in the direction of arrow 48 onto a conveyor (not shown) which advances sheet 44 to fusing station E.

Fusing station E includes a fuser assembly, indicated generally by the reference numeral 50, which permanently affixes the toner powder image to sheet 44. Preferably, fuser assembly 50 includes a heated fuser roller 52 and a back-up roller 54. Sheet 44 passes between fuser roller 52 and back-up roller 54 with the toner powder image contacting fuser roller 52. In this manner, the toner powder image is permanently affixed to sheet 44. After fusing, a chute guides the advancing sheet 44 to a catch tray for subsequent removal from the printing machine by the operator.

Invariably, after the sheet of support material is separated from the photoconductive surface of belt 10, some residual particles remain adhering thereto. These residual particles are removed from the photoconductive surface at cleaning station F. Cleaning station F includes a rotatably mounted fibrous brush 56 in contact with the photoconductive surface. The particles are cleaned from the photoconductive surface by the rotation of brush 56. Subsequent to cleaning a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
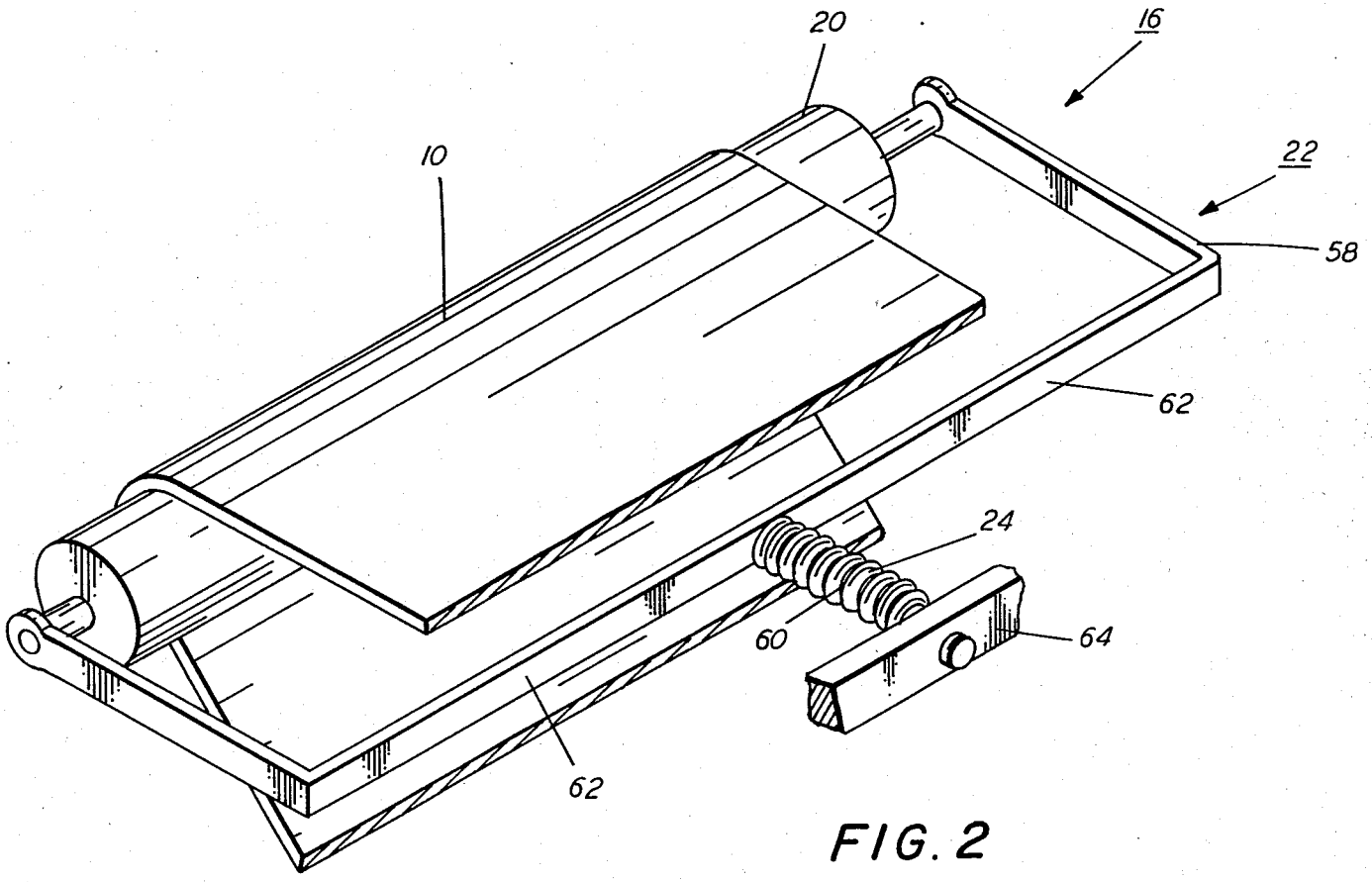
FIG. 2 is a fragmentary, perspective view showing the belt tensioning arrangement for the FIG. 1 printing machine.

Referring now to the specific subject matter of the present invention, FIG. 2 depicts tensioning system 16 in greater detail. As shown thereat, tensioning system 16 includes roller 20 having belt 10 passing thereover. Roller 20 is mounted in suitable bearings in a yoke, indicated generally by the reference numeral 22. Preferably, yoke 22 includes a U-shaped member 58 supporting roller 20 and a rod 60 secured to the mid-point of cross member 62 of U-shaped member 58. A coil spring 24 is wrapped around rod 60. Rod 60 is mounted slidably in the printing machine frame 64. Coil spring 24 is compressed between cross member 62 and frame 64. Compressed spring 24 resiliently urges yoke 22 and, in turn, roller 20 against belt 10. Spring 24 is designed to have the appropriate spring constant such that when placed under the desired compression, belt 10 is tensioned to about 0.1 killograms per linear centimeter. Belt 10 is maintained under a sufficiently low tension to enable the developer material on developer roll 40 to deflect belt 10 around developer roller 40 through an arc ranging up to about 20° defining a wrapped development zone.

One skilled in the art will appreciate that belt 10 may be supported by a platen and remain substantially flat. In this latter embodiment, the photoconductive belt 10 does not wrap around developer roller 40. Thus, the apparatus of the present invention will improve development of electrostatic latent images recorded on a flexible photoconductive member having a 0° wrap angle or a substantially rigid photoconductive member not wrapped about developer roller 40.

Figure 3:
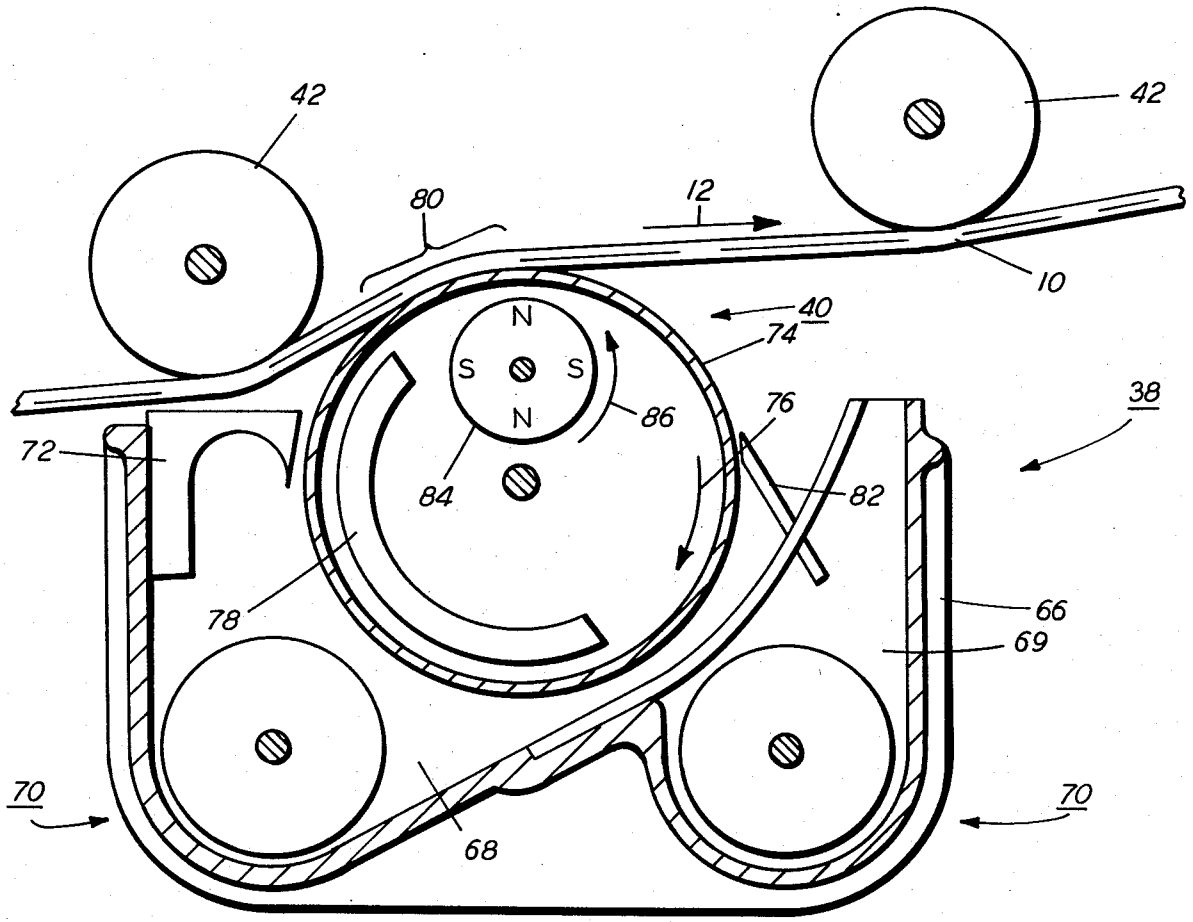
FIG. 3 is an elevational view illustrating the development system used in the FIG. 1 printing machine.

Turning now to FIG. 3, the detailed structure of development system 38 will be described. Development system 38 includes a housing 66 defining chambers 68 and 69 for storing a supply of developer material therein. A pair of augers 70 mix the developer material in chamber 68 and 69 of housing 66 and advance the developer material to developer roller 40. Developer roller 40 advances the developer material into contact with the electrostatic latent image recorded on the photoconductive surface of belt 10. A trim bar 72 regulates the thickness of the developer pile height on developer roller 40. Developer roller 40 includes a non-magnetic tubular member preferably made from aluminum having the exterior circumferential surface thereof roughened. Tubular member 74 rotates in the direction of arrow 76. An arcuate magnet 78 is mounted interiorly of tubular member 74 and spaced therefrom. Magnet 78 is stationary and positioned to attract the developer material to the exterior circumferential surface of tubular member 74 before development zone 80. In this way, as tubular member 74 rotates in the direction of arrow 76, developer material is attracted to the exterior circumferential surface thereof before entering development zone 80. Preferably, magnet 78 extends through an arc of about 180°. After the developer material exits development zone 80, it is capable of falling freely from tubular member 74 inasmuch as there is little or no magnetic forces attracting the developer material thereto. Blade 82 may scrap unused developer material from tubular member 74 returning it to chamber 69 of developer housing 66 for remixing with the remaining developer material therein. A cylindrical magnet 84 is positioned interiorly of tubular member 74 and opposed from development zone 80. Magnet 84 rotates in the direction of arrow 86, the developer material on tubular member 74 passing through development zone 80 is highly agitated. It has been found that high permeability developer material appears to translate with the surface of tubular member 74 and, superimposed thereover are waves of radial and tangential structures of the brush which follow the poles of the rotating magnet 84. Thus, a point on the electrostatic latent image experiences successively several different radial and tangential brushes as it moves through development zone 80. A low permeability developer material moves through development zone 80 differently. The brush of developer material which is formed in the radial field region is much denser and softer. The motion of the developer material over tubular member 74 appears, at least partially, to be due to a series of flips, in which chains of developer material respond to the changing magnetic field and the friction on the surface of tubular member 74. By way of example, both magnet 78 and magnet 84 are made from barium ferrite having magnetic poles impressed on the surface thereof. Preferably, the magnetic roller 84 rotates at an angular velocity significantly greater than the angular velocity of tubular member 74. Preferably, magnetic roller 84 rotates at an angular velocity equal to or greater than three to four times the angular velocity of tubular member 74. By way of example, if the diameter of tubular member 74 is 2.5 inches, the diameter of magnetic roller 84 will be 0.88 inches. Under these circumstances, it is preferable that tubular member 74 have a tangential velocity in development zone 80 of about 30 inches per second. Hence, tubular member 74 will rotate at an angular velocity of about 230 revolutions per minute. Magnetic roller 84 will, in turn, rotate at an angular velocity equal to or greater than 900 revolutions per minute. The compressed pile height of the developer material in development zone 80 ranges from about 0.20 inches to about 0.40 inches. It is thus clear that the diameter of rotating magnet 84 is less than the radius of tubular member 74.

Tubular member 74 is electrically biased by a voltage source (not shown) to a suitable polarity and magnitude. The voltage level is intermediate that of the background voltage level and the image voltage level recorded on the photoconductive surface of belt 10. By way of example, the voltage source electrically biases tubular member 74 to a voltage ranging from about 50 volts to about 350 volts. A motor (not shown) rotates tubular member 74 and magnetic roller 84 at the appropriate speeds. This may be readily achieved by coupling the shafts of tubular member 74 and magnetic roller 84 to the drive shaft of the motor through the appropriate gearing ratios. Alternatively, tubular member 74 may be driven by a dedicated motor and, similarly, magnetic roller 84 may also be driven by a dedicated motor.

It is clear that the development system of the present invention significantly reduces the field collapse limitations by magnetic agitation of the developer material in the development zone. Copy quality has been found to be significantly improved in a system of this type. When an insulating developer material is employed, some of the beneficial results of multiroll development are obtained through the utilization of only a single developer roller. If a conductive developer material is employed, more toner particles may be presented to the latent image, resulting in greater latitude with respect to toner particle concentration in the developer material. If a developer material employing low permeability, low density carrier granules is used, very high copy quality with generally less mechanical scrubbing and scratching of the photoconductive surface and better line raggedness and solid area uniformity is obtained. Finally, with any developer material, this system reduces the need for large frictional forces between the developer roller and the photoconductive surface to achieve developer material agitation so as to improve the life and wear characteristics of the photoconductive surface while reducing developer material aging.

It is, therefore evident that there has been provided in accordance with the present invention an apparatus for developing an electrostatic latent image that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing a latent image recorded on a member, including:

a tubular member journaled for rotary movement, positioned closely adjacent to the member defining a development zone therebetween, for transporting developer material into contact with the member in the development zone so as to develop the latent image record thereon;

a stationarily mounted magnetic member disposed interiorly of and spaced from said tubular member to attract the developer material to at least the portion of the circumferential surface of said tubular member located before the development zone; and a rotatably mounted magnetic member disposed interiorly of and spaced from said tubular member, said rotatably mounted magnetic member being positioned opposed from the development zone to agitate the developer material passing therethrough during the rotation thereof.

2. An apparatus according to claim 1, wherein said rotatably mounted magnetic member is cylindrical with the axis of rotation thereof being spaced from and substantially parallel to the axis of rotation of said tubular member.

3. An apparatus according to claim 2, wherein the diameter of said cylindrical magnet is less than the radius of said tubular member.

4. An apparatus for developing a latent image recorded on a member, including:

means for transporting developer material, said transporting means being positioned closely adjacent to the member to define a development zone therebetween, said transporting means transporting developer material into contact with the member in the development zone so as to develop the latent image recorded thereon; said transporting means including a tubular member journaled for rotary movement;

means for agitating magnetically the developer material being transported through the development zone on said transporting means to improve development of the latent image, said agitating means including a rotatably mounted magnetic member disposed interiorly of and spaced from said tubular member, said rotatably mounted magnetic member being positioned opposed from the development zone to agitate the developer material passing therethrough during the rotation thereof, said rotatably mounted magnetic member being cylindrical with the axis of rotation thereof spaced from and substantially parallel to the axis of rotation of said tubular member and the diameter of said cylindrical magnet being less than the radius of said tubular member and said cylindrical magnet rotating at a greater angular velocity than the angular velocity of said tubular member; and means for attracting the developer material to at least a portion of said transporting means, said attracting means including a stationarily mounted magnetic member disposed interiorly of and spaced from said tubular member to attract the developer material to at least the portion of the circumferential surface of said tubular member located before the development zone.

5. An apparatus according to claim 4, wherein said stationarily mounted magnetic member is arcuate and spaced from said cylindrical magnet.

6. An apparatus according to claim 5, wherein the member having the latent image recorded thereon is a flexible belt.

7. An apparatus according to claim 6, further including means for maintaining the flexible belt at a preselected tension of sufficient magnitude so that the developer material being transported into contact therewith deflects the flexible belt about said transporting means to form a wrapped development zone.

8. An electrophotographic printing machine of the type having an electrostatic latent image recorded on a flexible photoconductive belt, wherein the improvement includes:

a tubular member journaled for rotary movement, positioned closely adjacent to the photoconductive belt defining a development zone therebetween, for transporting developer material into contact with the photoconductive belt in the development zone so as to develop the latent image recorded thereon;

a stationarily mounted magnetic member disposed interiorly of and spaced from said tubular member to attract the developer material to at least the portion of the circumferential surface of said tubular member located before the development zone; and a rotatably mounted magnetic member disposed interiorly of and spaced from said tubular member, said rotatably mounted magnetic member being positioned opposed from the development zone to agitate the developer material passing therethrough during the rotation thereof.

9. A printing machine according to claim 8, wherein said rotatably mounted magnetic member is cylindrical with the axis of rotation thereof being spaced from and substantially parallel to the axis of rotation of said tubular member.

10. A printing machine according to claim 9, wherein the diameter of said cylindrical magnet is less than the radius of said tubular member.

11. An electrophotographic printing machine of the type having an electrostatic latent image recorded on a flexible photoconductive belt, wherein the improvement includes:

means for transporting developer material, said transporting means being positioned closely adjacent to the photoconductive member to define a development zone therebetween, said transporting means transporting developer material into contact with the photoconductive member in the development zone so as to develop the latent image recorded thereon, said transporting means including a tubular member journaled for rotary movement;

means for agitating magnetically the developer material being transported through the development zone on said transporting means to improve development of the latent image, said agitating means including a rotatably mounted magnetic member disposed interiorly of and spaced from said tubular member, said rotatably mounted magnetic member being positioned opposed from the development zone to agitate the developer material passing therethrough during the rotation thereof, said rotatably mounted magnetic member being cylindrical with the axis of rotation thereof spaced from and substantially parallel from and substantially parallel to the axis of rotation of said tubular member and the diameter of said cylindrical magnet being less than the radius of said tubular member, and said cylindrical magnet rotating at a greater angular velocity than the angular velocity of said tubular member; and means for attracting the developer material to at least a portion of said transporting means, said attracting means including a stationarily mounted magnetic member disposed interiorly of and spaced from said tubular member to attract the developer material to at least the portion of the circumferential surface of said tubular member located before the development zone.

12. A printing machine according to claim 11, wherein said stationarily mounted magnetic member is arcuate and spaced from said cylindrical magnet.

13. A printing machine according to claim 12, further including means for maintaining the flexible belt at a preselected tension of sufficient magnitude so that the developer material being transported into contact therewith deflects the flexible belt about said transporting means to form a wrapped development zone.

* * * * *